US008586272B2

(12) United States Patent
Nosella et al.

(10) Patent No.: US 8,586,272 B2
(45) Date of Patent: Nov. 19, 2013

(54) TONER COMPOSITIONS

(75) Inventors: Kimberly D. Nosella, Mississauga (CA); Maria N. V. McDougall, Oakville (CA); Melanie Lynn Davis, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 905 days.

(21) Appl. No.: 12/510,375

(22) Filed: Jul. 28, 2009

(65) Prior Publication Data

US 2011/0027712 A1 Feb. 3, 2011

(51) Int. Cl.
*G03G 9/08* (2006.01)

(52) U.S. Cl.
USPC ..... 430/108.2; 430/109.1; 430/109.2; 430/109.3; 430/109.31; 430/109.4

(58) Field of Classification Search
USPC ..... 430/109.1–109.4
See application file for complete search history.

(56) References Cited

U.S. PATENT DOCUMENTS

| | | | | |
|---|---|---|---|---|
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,847,604 | A | 11/1974 | Hagenbach et al. | |
| 3,944,493 | A | 3/1976 | Jadwin et al. | |
| 3,983,045 | A | 9/1976 | Jugle et al. | |
| 4,007,293 | A | 2/1977 | Mincer et al. | |
| 4,079,014 | A | 3/1978 | Burness et al. | |
| 4,265,990 | A | 5/1981 | Stolka et al. | |
| 4,394,430 | A | 7/1983 | Jadwin et al. | |
| 4,560,635 | A | 12/1985 | Hoffend et al. | |
| 4,563,408 | A | 1/1986 | Lin et al. | |
| 4,584,253 | A | 4/1986 | Lin et al. | |
| 4,858,884 | A | 8/1989 | Harwath | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 6,004,714 | A | 12/1999 | Ciccarelli et al. | |
| 6,063,827 | A | 5/2000 | Sacripante et al. | |
| 6,120,967 | A | 9/2000 | Hopper et al. | |
| 6,180,747 | B1 | 1/2001 | Sacripante et al. | |
| 6,190,815 | B1 | 2/2001 | Ciccarelli et al. | |
| 6,291,122 | B1 | 9/2001 | Sacripante et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 2005/0074684 | A1 * | 4/2005 | Yabuki et al. | 430/108.23 |
| 2005/0142476 | A1 * | 6/2005 | Kim et al. | 430/108.4 |
| 2005/0277041 | A1 * | 12/2005 | Lee et al. | 430/108.6 |
| 2006/0127272 | A1 | 6/2006 | Saitmacher et al. | |
| 2006/0216626 | A1 * | 9/2006 | Sacripante et al. | 430/109.4 |
| 2006/0222991 | A1 | 10/2006 | Sacripante et al. | |
| 2008/0233508 | A1 * | 9/2008 | Kamiyoshi et al. | 430/110.3 |
| 2009/0151599 | A1 * | 6/2009 | Fujii et al. | 106/31.47 |
| 2009/0181317 | A1 * | 7/2009 | Moriya | 430/109.4 |

* cited by examiner

*Primary Examiner* — Mark F Huff
*Assistant Examiner* — Rashid Alam
(74) *Attorney, Agent, or Firm* — Judith L. Byorick

(57) ABSTRACT

The present disclosure provides toner compositions able to prevent the formation of mold or bacterial growth during storage. In embodiments, toners may include at least one biocide that prevents the formation of mold and/or bacteria in a toner composition, including any emulsion that may be utilized in forming the toner composition. In embodiments, the biocide may also improve charging characteristics of the toner.

18 Claims, 1 Drawing Sheet

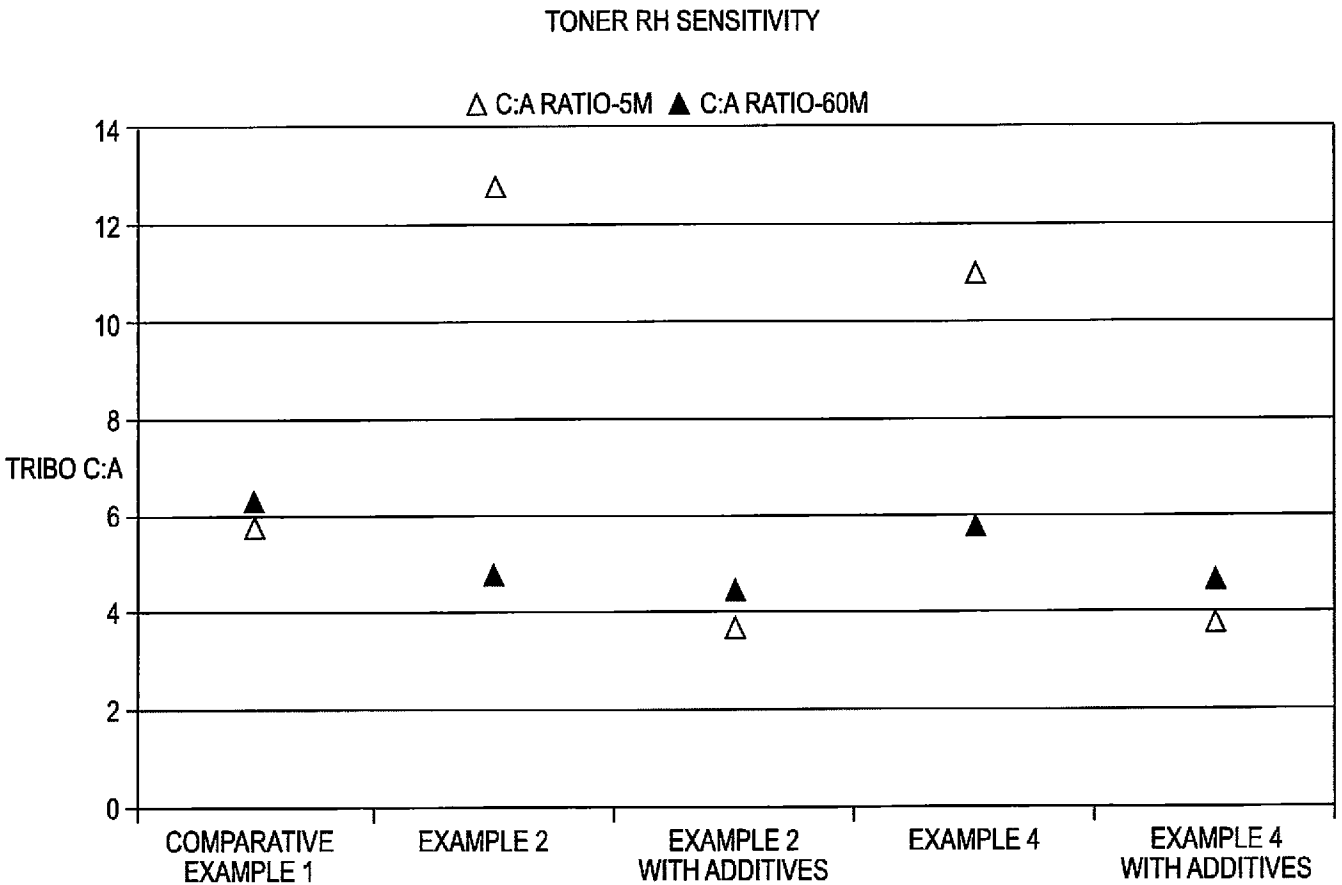
TONER RH SENSITIVITY
△ C:A RATIO-5M ▲ C:A RATIO-60M
TRIBO C:A
14
12
10
8
6
4
2
0
COMPARATIVE EXAMPLE 1
EXAMPLE 2
EXAMPLE 2 WITH ADDITIVES
EXAMPLE 4
EXAMPLE 4 WITH ADDITIVES

TONER COMPOSITIONS

BACKGROUND

The present disclosure is generally directed to toner compositions, and more specifically, to toner compositions including biocides capable of inhibiting the growth of mold, algae and/or bacteria in the toner compositions.

Electrophotographic printing utilizes toner particles which may be produced by a variety of processes. One such process includes an emulsion aggregation ("EA") process that forms toner particles in which surfactants are used in forming a latex emulsion. See, for example, U.S. Pat. No. 6,120,967, the disclosure of which is hereby incorporated by reference in its entirety, as one example of such a process.

Combinations of amorphous and crystalline polyesters may be used in the EA process. This resin combination may provide toners with high gloss and relatively low-melting point characteristics (sometimes referred to as low-melt, ultra low melt, or ULM), which allows for more energy efficient and faster printing. As the emulsions utilized to form these toners may include an aqueous phase, mold and/or bacteria may begin to grow if the emulsion is exposed to air.

There is a continual need for improving the process for forming EA ULM toners, including the use of components that will contribute to the storage stability of these compositions.

SUMMARY

The present disclosure provides toners and methods for making such toners, where the toners include a biocide. In embodiments, a toner of the present disclosure may include at least one resin; at least one biocide effective at a pH of from about 2 to about 14; and one or more optional ingredients selected from the group consisting of colorants, waxes, and combinations thereof.

In embodiments, a toner of the present disclosure may include at least one amorphous polyester resin; at least one biocide effective at a pH of from about 2 to about 14, present in an amount of from about 0.001 percent by weight to about 10 percent by weight of the toner; and one or more optional ingredients selected from the group consisting of colorants, waxes, and combinations thereof.

A process of the present disclosure may include contacting at least one amorphous polyester resin in combination with at least one crystalline polyester resin and at least one surfactant with an optional wax and an optional colorant; contacting the at least one amorphous polyester resin in combination with at least one crystalline polyester resin with from about 5 parts per million to about 1000 parts per million of at least one biocide effective at a pH of from about 2 to about 14 such as 5-chloro-2-methyl-4-isothiazolin-3-one, 2-methyl-4-isothiazolin-3-one, 1,2-benzisothiazolin-3-one, and combinations thereof; aggregating the at least one amorphous polyester resin in combination with at least one crystalline polyester resin with an aggregating agent to form aggregated particles; contacting the aggregated particles with at least one amorphous polymeric resin to form a shell over the aggregated particles; coalescing the aggregated particles to form toner particles; and recovering the toner particles.

BRIEF DESCRIPTION OF THE DRAWINGS

Various embodiments of the present disclosure will be described herein below with reference to the figures wherein:

The FIGURE is a graph showing the sensitivity to relative humidity (RH) for toners of the present disclosure compared with a control.

DETAILED DESCRIPTION

In embodiments, the present disclosure provides toner compositions that include at least one biocide. The biocide may prevent the growth of mold and bacteria in an emulsion including the toner components. In addition, the biocide may increase the charge stability of the toner over time under high relative humidity (RH) conditions (including those found in the A-zone of an electrophotographic apparatus) without any detrimental effect on other toner properties or fusing performance.

Resins

Any latex resin may be utilized in forming a toner of the present disclosure. Such resins, in turn, may be made of any suitable monomer. Any monomer employed may be selected depending upon the particular polymer to be utilized.

In embodiments, the resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like, including their structural isomers. The aliphatic diol may be, for example, selected in an amount of from about 40 to about 60 mole percent, in embodiments from about 42 to about 55 mole percent, in embodiments from about 45 to about 53 mole percent, and a second diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent, in embodiments from about 42 to about 52 mole percent, in embodiments from about 45 to about 50 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like.

Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly (propylene-succinate), poly(butylene-succinate), poly (pentylene-succinate), poly(hexylene-succinate), poly (octylene -succinate), poly(ethylene-sebacate), poly (propylene-sebacate), poly(butylene-sebacate), poly (pentylene-sebacate), poly(hexylene-sebacate), poly (octylene-sebacate), poly(decylene -sebacate), poly (decylene-decanoate), poly(ethylene-decanoate), poly (ethylene dodecanoate), poly(nonylene-sebacate), poly (nonylene-decanoate), copoly(ethylene-fumarate)-copoly (ethylene -sebacate), copoly(ethylene-fumarate)-copoly (ethylene-decanoate), copoly(ethylene-fumarate)-copoly (ethylene-dodecanoate), copoly2,2-dimethylpropane-1,3-diol-decanoate)-copoly(nonylene-decanoate), poly (octylene-adipate), and combinations thereof.

Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene -adipimide), poly (ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis,-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diols selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof In embodiments, a suitable polyester resin may be an amorphous polyester such as a poly(propoxylated bisphenol A co-fumarate) resin having the following formula (I):

(I)

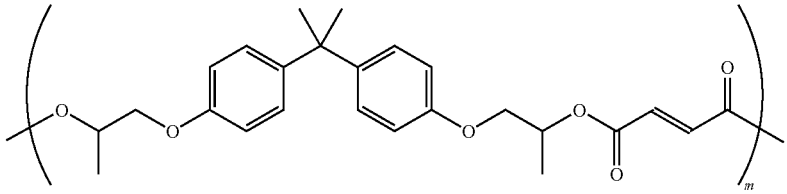

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

(II)

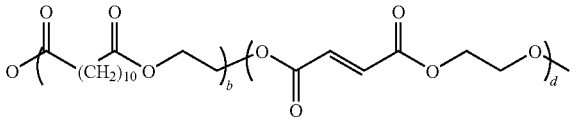

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a resin suitable for forming a toner.

In embodiments, the resin may be a branched amorphous resin. Examples of such resins include those disclosed in U.S. Pat. Nos. 6,180,747 and 6,291,122, the disclosures of each of which are hereby incorporated by reference in their entirety.

In embodiments, the resins may include polyester resins having a glass transition temperature of from about 30° C. to about 80° C., in embodiments from about 35° C. to about 70° C.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, in embodiments from about 75 to about 85 percent by weight of the toner particles (that is, toner particles exclusive of external additives) on a solids basis. Where the resin is a combination of a crystalline resin and amorphous resins, the ratio of crystalline resin to amorphous resin can be in embodiments from about 1:99 to about 30:70, in embodiments from about 5:95 to about 25:75, in some embodiments from about 5:95 to about 15:85.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PEIF, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Biocide

In embodiments, a biocide may be added to emulsions utilized to form toners of the present disclosure. As used herein, a biocide may include, in embodiments, for example, any material capable of inhibiting the growth of or killing an organism such as mold, bacteria, algae, combinations thereof, and the like. In embodiments, a suitable biocide may include, for example, any material capable of inhibiting the growth of, or killing an organism such as, mold, bacteria, algae, fungi, combinations thereof, and the like. In embodiments, a biocide may include a basic to acidic pH range bactericide, fungicide, algaecide, and/or preservative. The biocide may thus be effective and function at a pH of from about 2 to about 14, in embodiments from about 4 to about 11. Exemplary biocides include, in embodiments, 5-chloro-2-methyl-4-isothiazolin-3-one (sometimes referred to herein, in embodiments, as CIT), 2-methyl-4-isothiazolin-3-one (sometimes referred to herein, in embodiments, as MIT), 1,2-benzisothiazolin-3-one (sometimes referred to herein, in embodiments, as BIT) combinations thereof, and the like. CIT, MIT and/or BIT are broad spectrum non-oxidizing, non-toxic isothiazolinone biocides, bactericides, fungicides, and/or algaecides used in applications such as to preserve dry film, water treatment, oilfield, plastics, paper pulping, paint and marine coatings, personal care, and cosmetics. CIT, MIT, and/or BIT combined are cost effective for industrial preservation. In embodiments, a biocide of the present disclosure may include a mixture of 5-chloro-2-methyl-4-isothiazolin-3-one and 2-methyl-4-isothiazolin-3-one at a ratio of from about 1:5 to about 5:1, in embodiments from about 1:4 to about 4:1, in some embodiments about 3:1 CIT to MIT. In other embodiments, a biocide of the present disclosure may include a mixture of 2-methyl-4-isothiazolin -3-one and 1,2-benzisothiazolin-3-one at a ratio of from about 1:5 to about 5:1, in embodiments from about 1:4 to about 4:1, in some embodiments about 1:1 MIT to BIT.

Such biocides include those commercially available as ACTICIDE® CT, ACTICIDE® MV, and ACTICIDE® MBS, all from Thor Specialties Inc. The main difference between these biocides is how each biocide is stabilized; ACTICIDE® CT is stabilized with a non-metal salt and ACTICIDE® MV is stabilized with sodium nitrate.

The present disclosure includes an antimicrobially effective amount of the above biocides, to prevent the growth of mold, bacteria, algae, combinations thereof, and the like. In embodiments, a suitable amount of biocide may be from about 5 parts per million (ppm) to about 1000 ppm, in embodiments from about 10 ppm to about 50 ppm, in embodiments about 25 ppm.

The biocide may thus be present in a toner of the present disclosure in an amount of from about 0.001 percent by weight to about 10 percent by weight of the toner, in embodiments from about 0.002 percent by weight to about 2 percent by weight of the toner.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins and biocide(s) described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin and biocide(s). The pH of the resulting mixture may be adjusted by an acid such as, for example, acetic acid, nitric acid, or the like. In embodiments, the pH of the mixture may be adjusted to from about 3 to about 5. Additionally, in embodiments, the mixture may be homogenized. If the mixture is homogenized, homogenization may be accomplished by mixing at about 3000 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount oft for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above. The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 30° C. to about 70° C., in embodiments from about 35° C. to about 60° C., which may be below the glass transition temperature of the resin as discussed above.

Once the desired final size of the toner particles is achieved, the pH of the mixture may be adjusted with a base to a value of from about 6 to about 10, and in embodiments from about 6.2 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles.

Resins which may be utilized to form the shell include, but are not limited to, the amorphous resins described above. In embodiments, an amorphous resin which may be used to form a shell in accordance with the present disclosure may include an amorphous polyester of formula I above.

A single polyester resin may be utilized as the shell or, in embodiments, a first polyester resin may be combined with other resins to form a shell. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

Coalescence

Following aggregation to the desired particle size and application of any optional shell, the particles may then be coalesced to the desired final shape, the coalescence being achieved by, for example, heating the mixture to a temperature from about 45° C. to about 100° C., in embodiments from about 55° C. to about 85° C., which may be at or above the glass transition temperature of the resins utilized to form the toner particles, and reducing the pH of the toner slurry, for example from about 3 to about 7.5, in embodiments from about 6 to about 7. The fused particles can be measured for shape factor or circularity, such as with a Sysmex FPIA 2100 analyzer, until the desired shape is achieved.

Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −1 μC/g to about −45 μC/g, and a final toner charging after surface additive blending of from −3 μC/g to about −35 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 2.5 to about 20 μm, in embodiments from about 2.75 to about 10 μm, in other embodiments from about 3 to about 7.5 μm.

(2) Number Average Geometric Standard Deviation (GSDn) and/or Volume Average Geometric Standard Deviation (GSDv) of from about 1.18 to about 1.30, in embodiments from about 1.21 to about 1.24.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) Glass transition temperature of from about 45° C. to about 60° C., in embodiments from about 48° C. to about 55° C.

(5) The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It has been surprisingly found that the inclusion of a biocide of the present disclosure may aid in toner particles retaining their charge, including in environments having high relative humidity, for example, the A-zone conditioning apparatus (about 85% relative humidity (RH) and about 28° C.) for a period of time of from about 12 to about 48 hours, in embodiments from about 18 to about 36 hours. Toner particles of the present disclosure may also be able to retain their charge in environments having low relative humidity, for example, the C-zone conditioning apparatus (about 12% RH and about 15° C.) for a period of time of from about 12 hours to about 36 hours, in embodiments from about 18 hours to about 24 hours.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

Imaging methods are also envisioned with the toners disclosed herein. Such methods include, for example, some of the above patents mentioned above and U.S. Pat. Nos. 4,265,990, 4,858,884, 4,584,253 and 4,563,408, the disclosures of each of which are hereby incorporated by reference in their entirety. The imaging process includes the generation of an image in an electronic printing magnetic image character recognition apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

In accordance with the present disclosure, it has been found that the biocides can both prevent the growth of mold and bacteria in the emulsions, while at the same time provide increased stability of toner charging over time in higher RH conditions (A zone), with charge improvement observed over time. Moreover, it has been found that the small amounts of biocides added to the toners do not affect fusing or any other toner properties (for example, ICP or DSC) and performance, without the need for adjusting the toner process.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Comparative Example 1

A cyan polyester emulsion aggregation ultra low melt toner was prepared as follows. About 158 grams of a linear amorphous resin in an emulsion (about 50.2 weight % resin) was added to a 2 liter beaker. The linear amorphous resin was of the following formula:

(I)

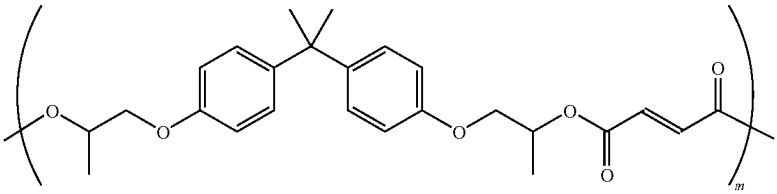

wherein m was from about 5 to about 1000, and was produced following the procedures described in U.S. Pat. No. 6,063,827, the disclosure of which is hereby incorporated by reference in its entirety. To this was added about 49 grams of an unsaturated crystalline polyester ("UCPE") resin composed of ethylene glycol and a mixture of dodecanedioic acid and fumaric acid co-monomers with the following formula:

(II)

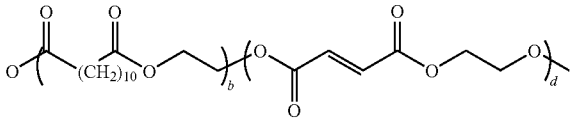

wherein b was from about 5 to about 2000 and d was from about 5 to about 2000, in an emulsion (about 12 weight % resin), synthesized following the procedures described in U.S. Patent Application Publication No. 2006/0222991, the disclosure of which is hereby incorporated by reference in its entirety.

To this was added about 18.5 grams of a branched amorphous resin in an emulsion (about 6 weight % resin), synthesized following the procedures described in U.S. Pat. Nos. 6,180,747 and 6,291,122, the disclosures of each of which are hereby incorporated by reference in their entirety; and about 32.7 grams of Pigment Blue 15:3, in a dispersion, were added to the beaker. About 1.45 grams of aluminum sulfate was added as a flocculent under homogenization by mixing at a speed of from about 3000 revolutions per minute (rpm) to about 4000 rpm for about 20 minutes, then aggregating to a batch temperature of about 47° C. to obtain about 134.36 grams dry toner.

During aggregation, a shell including one of the same amorphous emulsions in the core was added to achieve the targeted particle size of about 8 microns; the pH was adjusted to about 7.8 using sodium hydroxide (NaOH) and the aggregation step was frozen.

The process proceeded with the reactor temperature (Tr) being increased to about 72° C. while adjusting the pH down to about 6 using a buffer with a pH of about 5.7, until the Tr was about 69° C., at which point the particles began to coalesce. After about 1 hour, the particles possessed a circularity of greater than about 0.970 and were cooled.

Example 1

A cyan toner was prepared with about 25 ppm of ACTICIDE® CT added to a pre-made amorphous emulsion as follows. The emulsion described above in Comparative Example 1 above was prepared, including the amorphous resin, crystalline resin, gel, colorant, and aluminum sulfate. After formation of the emulsion, about 25 ppm of ACTICIDE® CT was added. Then all components were combined added together with homogenization and aggregation of the batch to a temperature of about 47° C.

Example 2

A cyan toner was prepared with about 25 ppm of ACTICIDE® CT added during the phase inversion emulsification (PIE) stage of toner formation as follows. A cyan polyester EA ULM toner was prepared as described in Comparative Example 1 above, with the addition of about 25 ppm ACTICIDE® CT was added to the gel emulsion, crystalline emulsion (UCPE), aluminum sulfate, and Pigment Blue 15:3 dispersion during the in-situ phase inversion process. Particles were aggregated at a batch temperature of about 49° C. During aggregation, a shell including the same amorphous emulsions in the core was added to achieve the targeted particle size of about 8 microns. Again, the aggregation step was frozen as in Comparative Example 1 by the adjustment of the pH with NaOH. The process proceeded with the reactor temperature increased to about 72° C., after which the pH was adjusted down to about 6 using a buffer with a pH of about 5.7 until the Tr was about 69° C., at which point the particles began to coalesce. After about 1 hour, the particles had a circularity of greater than about 0.970 and were cooled.

Example 3

A cyan toner was prepared with about 25 ppm of ACTICIDE® CT added to a pre-made emulsion as follows. The emulsion described above in Comparative Example 1 above was prepared, including the amorphous resin, crystalline resin, gel, colorant, and aluminum sulfate. After formation of the emulsion, about 25 ppm of ACTICIDE® CT was added, with homogenization and aggregation of the batch to a temperature of about 47° C.

During aggregation, a shell including one of the same amorphous emulsions in the core was added to achieve the targeted particle size as described above in Comparative Example 1. Aggregation was frozen as described above in Comparative Example 1 by adjusting the pH with NaOH. The process proceeded with the Tr increased to about 72° C., after which the pH was adjusted down to about 6 with a buffer having a pH of about 5.7 until the Tr was about 69° C. and the particles began to coalesce. After about 1 hour, the particles had a circularity of greater than about 0.970 and were cooled.

Example 4

A cyan toner was prepared with about 25 ppm of ACTICIDE® MV added to a pre-made emulsion as follows. The same process was followed as Example 3 above, except 25 ppm of ACTICIDE® MV was added to the pre-formed emulsion instead of the ACTICIDE® CT. A shell was added as in Comparative Example 1. Aggregation was frozen as described above in Comparative Example 1 by adjusting the pH with NaOH. The process proceeded with the Tr increased to about 72° C., after which the pH was adjusted down to about 6 with a buffer having a pH of about 5.7 until the Tr was about 69° C. and the particles began to coalesce. After about 1 hour, the particles had a circularity of greater than about 0.970 and were cooled.

Example 5

A cyan toner was prepared with about 15 ppm of ACTICIDE® CT added to a pre-made emulsion as follows. The process of Example 3 was followed, except about 15 ppm of ACTICIDE® CT was added to the pre-formed emulsion. A shell was added as in Comparative Example 1. Aggregation was frozen as described above in Comparative Example 1 by adjusting the pH with NaOH. The process proceeded with the Tr increased to about 72° C., after which the pH was adjusted down to about 6 with a buffer having a pH of about 5.7 until the Tr was about 69° C. and the particles began to coalesce. After about I hour, the particles had a circularity of greater than about 0.970 and were cooled.

Example 6

A cyan toner was prepared with about 15 ppm of ACTICIDE® MV added as a pre-made emulsion as follows. The process of Example 3 was followed, except about 15 ppm of ACTICIDE® MV was added to the pre-formed emulsion instead of the ACTICIDE® CT. A shell was added as in Comparative Example 1. Aggregation was frozen as described above in Comparative Example 1 by adjusting the pH with NaOH. The process proceeded with the Tr increased to about 72° C., after which the pH was adjusted down to about 6 with a buffer having a pH of about 5.7 until the Tr was about 69° C. and the particles began to coalesce. After about 1 hour, the particles had a circularity of greater than about 0.970 and were cooled.

The final particle data for the toners of the above Examples is summarized below in Table 1.

TABLE 1

| | Biocide | D50 | GSDv/GSDn | Circularity |
|---|---|---|---|---|
| Comparative Example 1 | Control - no biocide | 8.15 | 1.22/1.24 | 0.978 |
| Example 1 | 25 ppm ACTICIDE ® CT added after PIE | 8.33 | 1.2/1.24 | 0.972 |
| Example 2 | 25 ppm ACTICIDE ® CT added during PIE | 9.15 | 1.21/1.24 | 0.977 |
| Example 3 | 25 ppm ACTICIDE ® CT added after PIE | 7.74 | 1.21/1.24 | 0.981 |
| Example 4 | 25 ppm ACTICIDE ® MV added after PIE | 7.90 | 1.23/1.23 | 0.980 |
| Example 5 | 15 ppm ACTICIDE ® CT added after PIE | 8.15 | 1.21/1.22 | 0.978 |
| Example 6 | 15 ppm ACTICIDE ® MV added after PIE | 7.90 | 1.22/1.23 | 0.977 |

Toner Charging Performance. The toners from the above Examples were combined with a polymethyl methacrylate carrier, Xerox XP-454 carrier. Xerox XP-454 carrier is a conductive polymer composite manufactured by and proprietary to the Xerox Corporation. It is often used as a conductive powder coating for carriers and is made from a polymethyl methacrylate polymer containing carbon black. The carrier was included at a toner concentration of about 4.5 parts per hundred (pph). Developers were conditioned in the A-zone (AZ (85% RH and 28° C.)) and C-zone (CZ (12% RH and 15° C.)) for a minimum period of about 18 hours. After the conditioning period, all developers were charged using a paint shaker for a period of about 5 minutes and about 60 minutes. The purpose of the charging evaluation was to understand developer charging behavior at short and long charging times, under the two extreme ambient conditions.

The results are summarized in Table 2 below. As can be seen from Table 2, all the toners containing biocide showed a consistent trend to increase toner charging with time and between RH zones. (Toner charging at high RH conditions is a very important parameter to be able to control.) Usually at high RH conditions the charge falls off, as can be seen with the toner of Comparative Example 1 (without biocide). However, the date surprisingly shows that the charge was maintained with toners that contained the biocide.

TABLE 2

| | Biocide | Q/m AZ-5M | Q/m AZ-60M | Q/m CZ-5M | Q/m CZ-60M |
|---|---|---|---|---|---|
| Comparative Example 1 | None | −6.78 | −4.27 | −39.42 | −35.69 |
| Example 1 | 25 ppm ACTICIDE ® CT add after PIE | −3.27 | −5.28 | −30.34 | −32.79 |
| Example 2 | 25 ppm ACTICIDE ® CT add during PIE | −4.14 | −6.48 | −35.99 | −38.59 |

TABLE 2-continued

| | Biocide | Q/m AZ-5M | Q/m AZ-60M | Q/m CZ-5M | Q/m CZ-60M |
|---|---|---|---|---|---|
| Example 3 | 25 ppm ACTICIDE ® CT add after PIE | −1.92 | −3.58 | −24.54 | −30.31 |
| Example 4 | 25 ppm ACTICIDE ® MV add after PIE | −2.76 | −4.03 | −30.31 | −23.09 |
| Example 5 | 15 ppm ACTICIDE ® CT add after PIE | −2.05 | −3.64 | −20.59 | −10.64 |
| Example 6 | 15 ppm ACTICIDE ® MV add after PIE | −2.63 | −4.31 | −21.54 | −8.65 |

As can also be seen from Table 2, the biocide was effective when added to the emulsion either in-situ or after formation of the emulsion, and still provided an improved effect on charging. In all cases, the A-zone charging increased with time, which was unexpected. The C-zone charging was more dependent on the amount added and the type of biocide used. (A small decrease in C-zone charging with time may be desirable, as it decreased toner RH sensitivity.)

Bench charging evaluations were also performed after blending the toners of Examples 2 and 4 with an additive package including NA50HS ($SiO_2$), SMT5103($TiO_2$), ZnST, H2050 (positive $SiO_2$). All additives were blended in one step using a small lab mill at 13,000 RPM and 30 seconds. Developer charging increased, and charge stability was observed and maintained with both biocides. (Charging stability is a critical parameter to maintain printing quality and color fidelity for high speed printers.) A summary of the data for the bench charging evaluations of these toners with and without the surface additives, is provided in Table 3 below.

TABLE 3

| | Biocide | Q/m AZ-5M | Q/m AZ-60M | Q/m CZ-5M | Q/m CZ-60M |
|---|---|---|---|---|---|
| Example 3 | 25 ppm ACTICIDE ® CT added after PIE | −1.92 | −3.58 | −24.54 | −30.31 |
| Example 3 | 25 ppm ACTICIDE ® CT added after PIE with surface additive package | −6.78 | −6.71 | −25.03 | −29.79 |
| Example 4 | 25 ppm ACTICIDE ® MV added after PIE | −2.76 | −4.03 | −30.31 | −23.09 |
| Example 4 | 25 ppm ACTICIDE ® MV added after PIE with surface additives package | −7.04 | −6.19 | −26.44 | −28.76 |

A summary of the triboelectric charging for these toners, as a function of RH sensitivity, is provided in the Figure; the RH sensitivity was greatly improved with additive blending and was consistent; changes of RH sensitivity over time were not observed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner composition comprising:

at least one resin;

at least one biocide effective at a pH of from about 2 to about 14; and one or more optional ingredients selected from the group consisting of colorants, waxes, and combinations thereof, said toner composition being an emulsion aggregation toner composition, wherein the at least one biocide is selected from the group consisting of 5-chloro-2-methyl-4-isothiazolin-3-one, 2-methyl-4-isothiazolin-3-one, and combinations thereof.

2. The composition of claim 1, wherein the at least one resin comprises at least one amorphous resin in combination with at least one crystalline resin.

3. The composition of claim 1, wherein the at least one resin comprises an amorphous polyester resin of the formula:

I

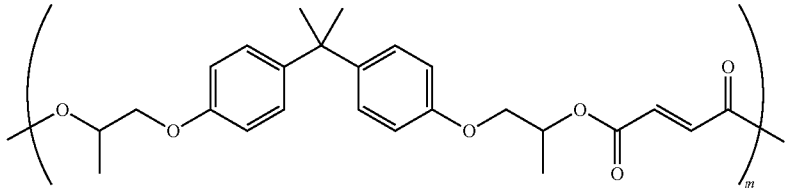

wherein m may be from about 5 to about 1000, in combination with a crystalline polyester resin of the formula:

II

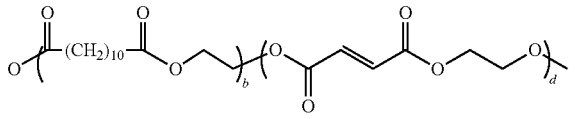

wherein b is from about 5 to about 2000 and d is from about 5 to about 2000.

4. The composition of claim 1, wherein the at least one resin further comprises a crosslinked resin.

5. The composition of claim 1, wherein the at least one biocide is present in an amount of from about 0.001 percent by weight to about 10 percent by weight of the toner.

6. The composition of claim 1, wherein the toner comprises particles possessing a core shell configuration, the shell formed of an amorphous polyester resin, a branched polyester resin, and combinations thereof.

7. The composition of claim 1, wherein the toner possesses a charge of from about −1 μC/g to about −45 μC/g at about 85% relative humidity and a temperature of about 28° C.

8. The composition of claim 7, wherein the toner is able to maintain its charge for a period of time of from about 12 hours to about 48 hours.

9. A toner composition comprising:

at least one amorphous polyester resin;

at least one biocide effective at a pH of from about 2 to about 14, present in an amount of from about 0.001 percent by weight to about 10 percent by weight of the toner; and one or more optional ingredients selected from the group consisting of colorants, waxes, and combinations thereof, said toner being an emulsion aggregation toner composition, wherein the at least one biocide is selected from the group consisting of 5-chloro-2-methyl-4-isothiazolin-3-one, 2-methyl-4-isothiazolin-3-one, and combinations thereof.

10. The composition of claim 9, wherein the at least one amorphous polyester resin is of the formula:

I

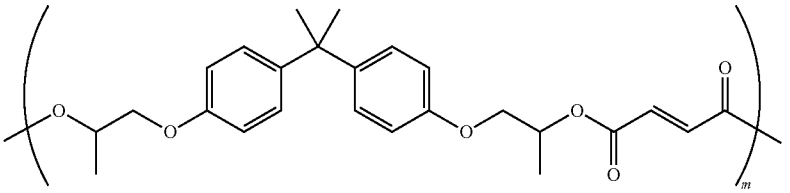

wherein b is from about 5 to about 2000 and d is from about 5 to about 2000.

11. The composition of claim 9, wherein the at least one resin further comprises a crosslinked resin.

12. The composition of claim 9, wherein the toner comprises particles possessing a core shell configuration, the shell formed of a linear amorphous polyester resin, a branched amorphous polyester resin, and combinations thereof.

13. The composition of claim 9, wherein the toner possesses a charge of from about −1 μC/g to about −45 μC/g at about 85% relative humidity and a temperature of about 28° C.

14. The composition of claim 13, wherein the toner is able to maintain its charge for a period of time of from about 12 hours to about 48 hours.

15. A process comprising:

contacting at least one amorphous polyester resin in combination with at least one crystalline polyester resin and at least one surfactant with an optional wax and an optional colorant;

contacting the at least one amorphous polyester resin in combination with at least one crystalline polyester resin with from about 5 parts per million to about 1000 parts per million of at least one biocide effective at a pH of from about 2 to about 14 selected from the group consisting of 5-chloro-2-methyl-4-isothiazolin-3-one, 2-methyl-4-isothiazolin-3-one, and combinations thereof;

aggregating the at least one amorphous polyester resin in combination with at least one crystalline polyester resin with an aggregating agent to form aggregated particles;

contacting the aggregated particles with at least one amorphous polymeric resin to form a shell over the aggregated particles;

coalescing the aggregated particles to form toner particles; and recovering the toner particles.

16. The process of claim 15, wherein the at least one biocide is contacted with the at least one amorphous polyester resin in combination with at least one crystalline polyester resin at the time of forming an emulsion.

17. The process of claim 15, wherein the at least one biocide is contacted with the at least one amorphous polyester resin in combination with at least one crystalline polyester resin after the formation of an emulsion.

18. The process of claim 15, wherein the toner possesses a charge of from about −1 μC/g to about −45 μC/g at about 85% relative humidity and a temperature of about 28° C., and wherein the toner is able to maintain its charge for a period of time of from about 12 hours to about 48 hours.

* * * * *